US010544663B2

(12) United States Patent
Modeland

(10) Patent No.: US 10,544,663 B2
(45) Date of Patent: Jan. 28, 2020

(54) METHOD OF WELL COMPLETION

(71) Applicant: Halliburton Energy Services, Inc., Houston, TX (US)

(72) Inventor: Neil Joseph Modeland, Rosenberg, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 132 days.

(21) Appl. No.: 15/761,999

(22) PCT Filed: Dec. 9, 2015

(86) PCT No.: PCT/US2015/064809
§ 371 (c)(1),
(2) Date: Mar. 21, 2018

(87) PCT Pub. No.: WO2017/099764
PCT Pub. Date: Jun. 15, 2017

(65) Prior Publication Data
US 2018/0274346 A1 Sep. 27, 2018

(51) Int. Cl.
*E21B 43/14* (2006.01)
*E21B 43/28* (2006.01)
(Continued)

(52) U.S. Cl.
CPC ..... *E21B 43/14* (2013.01); *E21B 33/12* (2013.01); *E21B 43/116* (2013.01);
(Continued)

(58) Field of Classification Search
CPC ..... E21B 17/1092; E21B 10/43; E21B 10/62; E21B 10/55; E21B 43/11; E21B 43/119
See application file for complete search history.

(56) References Cited

U.S. PATENT DOCUMENTS 3,957,115 A * 5/1976 Kerzee ..... E21B 23/02 166/297
4,637,468 A 1/1987 Derrick
(Continued)

OTHER PUBLICATIONS

International Search Report and Written Opinion issued by the Korean Intellectual Property Office regarding related International Application No. PCT/US2015/064809, 15 pages dated Sep. 1, 2016.
(Continued)

*Primary Examiner* — Michael R Wills, III
(74) *Attorney, Agent, or Firm* — Haynes and Boone, LLP

(57) ABSTRACT

A method for well completion employs a combined plugging and perforating operation for creating multiple spaced-apart clusters of perforations and optional stimulation treatments in stages. For each stage to be completed, a frac plug, carried, for example, along a wireline bottom hole assembly with perforating guns, is set in the wellbore distal (toward the toe end of the well) of the most proximal perforation cluster of the previous stage, thereby maintaining open hole conditions that provide adequate flow past the most distal perforation clusters in the current stage and minimizing proppant accumulation in the wellbore from stimulation operations. The method further allows subsequent pump down of tools and equipment even with the plug set in the wellbore.

19 Claims, 14 Drawing Sheets

(51) Int. Cl.

| | |
|---|---|
| ***E21B 43/26*** | (2006.01) |
| ***E21B 43/117*** | (2006.01) |
| ***E21B 43/116*** | (2006.01) |
| ***E21B 33/12*** | (2006.01) |
| *E21B 43/04* | (2006.01) |
| *E21B 43/267* | (2006.01) |

(52) U.S. Cl.
CPC ..... *E21B 43/117* (2013.01); *E21B 43/26* (2013.01); *E21B 43/28* (2013.01); *E21B 43/04* (2013.01); *E21B 43/267* (2013.01)

(56) References Cited

U.S. PATENT DOCUMENTS

| | | | | |
|---|---|---|---|---|
| 4,951,751 | A | 8/1990 | Jennings, Jr. | |
| 5,704,426 | A | 1/1998 | Rytlewski et al. | |
| 9,109,415 | B2 * | 8/2015 | Coles | E21B 23/08 |
| 2001/0050172 | A1 * | 12/2001 | Tolman | E21B 17/203 166/297 |
| 2005/0178551 | A1 | 8/2005 | Tolman et al. | |
| 2012/0168180 | A1 | 7/2012 | Johnson et al. | |
| 2013/0138254 | A1 * | 5/2013 | Seals | E21B 23/08 700/282 |
| 2013/0264054 | A1 * | 10/2013 | East | E21B 34/14 166/270.1 |

OTHER PUBLICATIONS

Canadian Intellectual Property Office Action, App. No. 2,999,197, dated Jan. 11, 2019, pp. 1-4.

* cited by examiner

METHOD OF WELL COMPLETION

TECHNICAL FIELD

The present disclosure relates generally to operations performed and equipment utilized in conjunction with a subterranean well such as a well for recovery of oil, gas, or minerals.

More particularly, the disclosure relates to techniques for completing wellbores in the earth.

BACKGROUND

Well completion refers to various operations to prepare a well for production, and may include casing, cementing, perforating, stimulating, gravel packing, hanging production tubing, and installing a christmas tree at the wellhead.

After drilling a subterranean wellbore, individual lengths of metal tubulars are typically secured together to form a production casing string that is positioned within the portion of the wellbore that traverses a pay zone. Production casing string increases the integrity of the wellbore and provides a path for producing fluids from producing intervals within the pay zone to the surface. Conventionally, the production casing string is cemented within the wellbore, initially forming a closed hole. To produce fluids into the production casing string, hydraulic openings or perforations must be formed through the casing string, the cement sheath, and a short distance into the formation.

These perforations may be created by a perforating gun. A series of shaped charges are held in a hollow steel carrier. The perforating gun is positioned within the cased wellbore by a tubing string, wireline, slick line, coiled tubing, or other conveyance. Once the perforating gun is properly positioned in the wellbore adjacent to the formation to be perforated, the shaped charges may be detonated, thereby creating perforations through the hollow steel carrier and the desired hydraulic openings through the casing and cement sheath into the formation.

Perforating operations may be performed in stages, intervaled by optional stimulating and/or gravel packing operations. Stimulating operations may include, for example, acidizing or hydraulic fracturing. Accordingly, as a perforating gun is run into a wellbore for perforating a given stage, a settable plug may also be run by the conveyance carrying the perforating gun. The plug may be set between a previously perforated, stimulated and/or packed stage and the next adjacent stage to be perforated, thereby isolating the previously completed stage to allow pressurization of the newly perforated stage for stimulation and gravel pack operations. After the plug is set, the next stage is perforated, and the perforating gun it is pulled from the wellbore. This operation of setting a plug and perforating may be colloquially referred to by routineers as "plug & perf." Stimulation and/or gravel pack operations may then be performed for the newly perforated stage. This process of plugging, perforating, and stimulating/gravel packing may be repeated stage by stage, moving uphole as the completion process continues.

BRIEF DESCRIPTION OF THE DRAWINGS

Embodiments are described in detail hereinafter with reference to the accompanying figures, in which.

DETAILED DESCRIPTION

Figure 1:
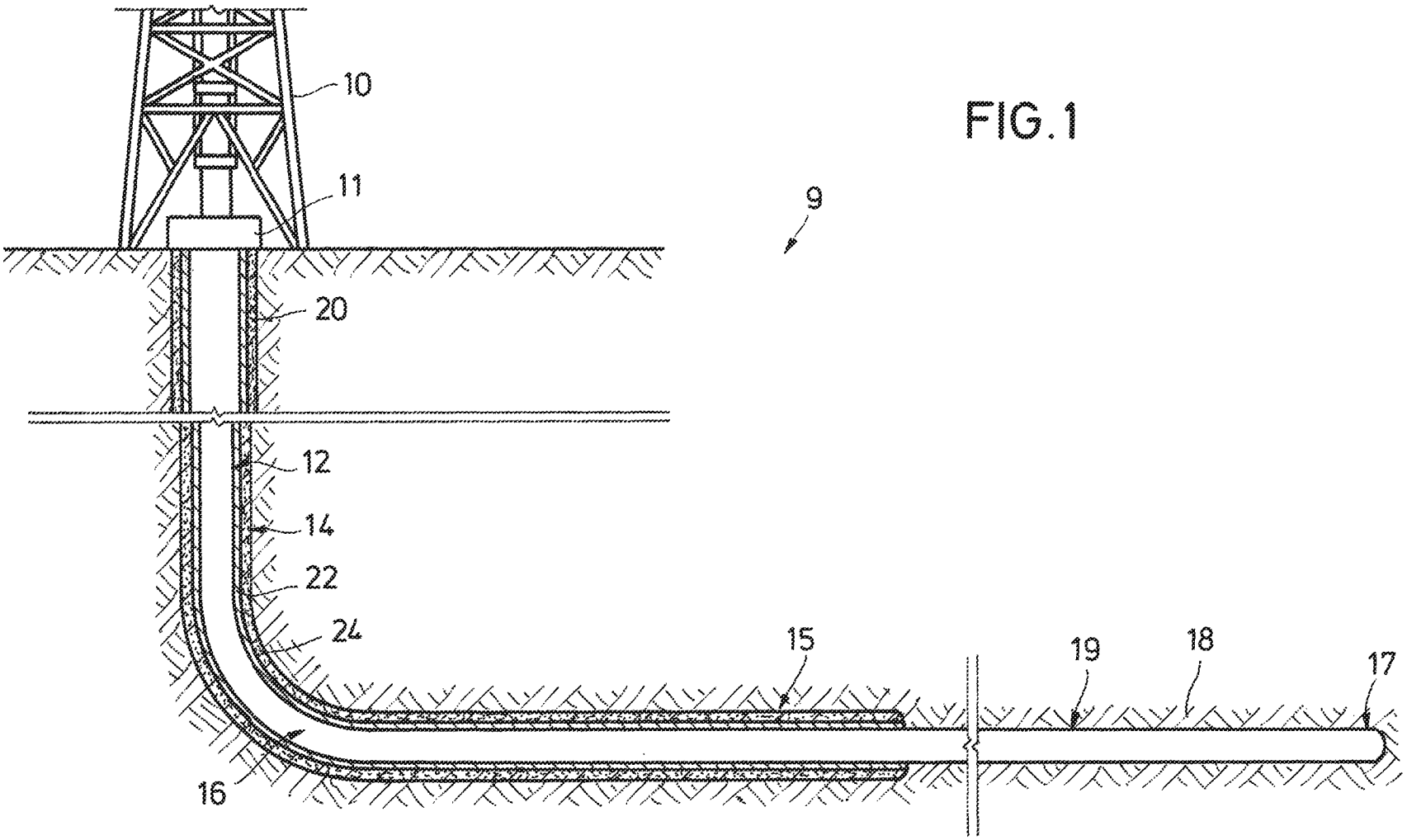
FIG. 1 is an elevation view in partial cross section of a well system according to an embodiment, showing a wellbore with a deviated section, lined with surface and intermediate casing but open to the formation at the pay zone.

The present disclosure may repeat reference numerals and/or letters in the various examples. This repetition is for the purpose of simplicity and clarity and does not in itself dictate a relationship between the various embodiments and/or configurations discussed. Further, spatially relative terms, such as "beneath," "below," "lower," "above," "upper," "uphole," "downhole," "upstream," "downstream," and the like, may be used herein for ease of description to describe one element or feature's relationship to another element(s) or feature(s) as illustrated in the figures. The spatially relative terms are intended to encompass different orientations of the apparatus in use or operation in addition to the orientation depicted in the figures. In addition, figures are not necessarily drawn to scale but are presented for simplicity of explanation.

Various equipage, such as fasteners, fittings, etc., may be omitted to simplify the description. However, routineers in the art will realize that such conventional equipment may be employed as appropriate.

FIG. 1 is an elevation view in partial cross-section of a well system, generally designated 9, according to an embodiment, shown prior to completion. Well system 9 may include drilling, completion, servicing, or workover rig 10. Rig 10 may be deployed on land or used in association with offshore platforms, semi-submersible, drill ships and any other well system satisfactory for completing a well. Rig 10 may be located proximate a wellhead 11, or it may be located at a distance, as in the case of an offshore arrangement. A blowout preventer, christmas tree, and/or other equipment associated with servicing or completing a wellbore (not illustrated) may also be provided at wellhead 11. Similarly, rig 10 may include a rotary table and/or top drive unit (not illustrated).

In the illustrated embodiment, a wellbore 12 extends through the various earth strata. Wellbore 12 may include a substantially vertical section 14 with a dogleg to a substantially horizontal or deviated section 15 that may extend through a hydrocarbon bearing subterranean formation, i.e., pay zone 18. Deviated section 15 may define a proximal heel 16 and a distal toe 17.

As illustrated, a surface casing 20, and possibly an intermediate casing 22, may be installed and secured within wellbore 12 by a cement sheath 24, as described below. Wellbore 12 is shown to initially extend into pay zone 18 as an open hole 19.

Surface casing 20 is typically the first casing string to be run when wellbore 12 is first drilled. Surface casing 20 is located the top part of the well and is attached to wellhead 11. The primary function of surface casing 20 is to protect the groundwater formation from contamination. Surface casing 20 is usually a few hundred feet deep and runs to the bottom of the hole at the beginning when drilling of wellbore 12 first begins.

Surface casing consist of multiple joints of large-diameter pipe that are screwed together one joint at a time as the casing is run. The first joint of surface casing to be run may include a guide shoe with a rounded base and a float valve (not illustrated). The guide shoe helps prevent the casing from catching on the sides of the wellbore as it is run, and the float valve prevents drilling mud extent in the hole from filling the casing string, thereby providing buoyancy to the casing string to lessen the load on the rig 10 and the top joints of the casing. As surface casing 20 is run in wellbore 12, it may be periodically filled at the surface with fluid, such as water, to reduce differential pressure that might cause the casing string to collapse. The casing string 20 may also include scratchers (not illustrated) to remove mud cake from the sides of the hole and centralizers (not illustrated) at select joints to allow cementing to evenly and completely surround the casing.

Once surface casing 12 has been run into the initial hole, cement sheath 24 may be formed as follows. First, a hard rubber rupture plug (not illustrated) may be inserted into surface casing 20. Next, a cement slurry may be pumped into surface casing 20 behind the rupture plug. The rupture plug separates the existing water in surface casing 20 from the cement slurry. The cement slurry pushes the rupture plug through the casing as it flows down and forces the rupture plug into a seat just above the float valve. Once the rupture plug is seated at the bottom of casing string 20, pumping pressure may be increased to rupture the plug, allowing the cement slurry to displace the existing mud in the annulus. Once an adequate quantity of cement slurry has been pumped, a second plug, called a seal plug, is then inserted into surface casing 20. The seal plug separates the cement slurry from fresh mud that will follow. Mud is pumped into surface casing 20, pushing the seal plug through the casing and displacing the cement slurry out of the casing into the annulus. The cement job is completed when the seal plug lands atop the float valve, indicated by a distinct increase in pressure. As pumping is ceased, the float valve shuts, preventing the heavier cement in the annulus from running back into the casing.

Cement sheath 24 in the annular space between surface casing 20 and the walls of the hole blocks fluid movement and pressure transmission up or down the annulus. Wellhead 11 acts to seal the annulus at the top end of surface casing 20. Once the surface casing the surface casing cement sheath 24 has cured, drilling of wellbore 12 resumes by drilling through the drillable shoe and the cement at the bottom of surface casing 20 (not illustrated) and into the formation using a bit (not illustrated) that fits inside surface casing 20.

As shown in FIG. 1, in deeper wells or where the formation becomes unstable because of prolonged contact with drilling mud, one or more intermediate casing strings 22, each of progressively smaller diameter, may be run and cemented in wellbore 12 as drilling continues. The primary function of intermediate casing 22 is to protect and support the hole. Intermediate casing strings 22 may be run and cemented in same manner as described above with respect to surface casing 20. It is important that the cement sheath surrounding each intermediate casing string 22 rises high enough in the annulus to reach and tie into the cement sheath 24 surrounding the casing above it so as to provide an unbroken cement sheath that covers the entire length of wellbore 12. Drilling, casing, and cementing operations are repeated for each successive string of intermediate casing 22. As shown in FIG. 1, drilling continues past the most distal intermediate casing string 22 until it reaches pay zone 18, whereupon open hole logging operations may be conducted to identify lithology, measure permeability, porosity, reservoir thickness, and fluid saturation levels.

Figure 2:
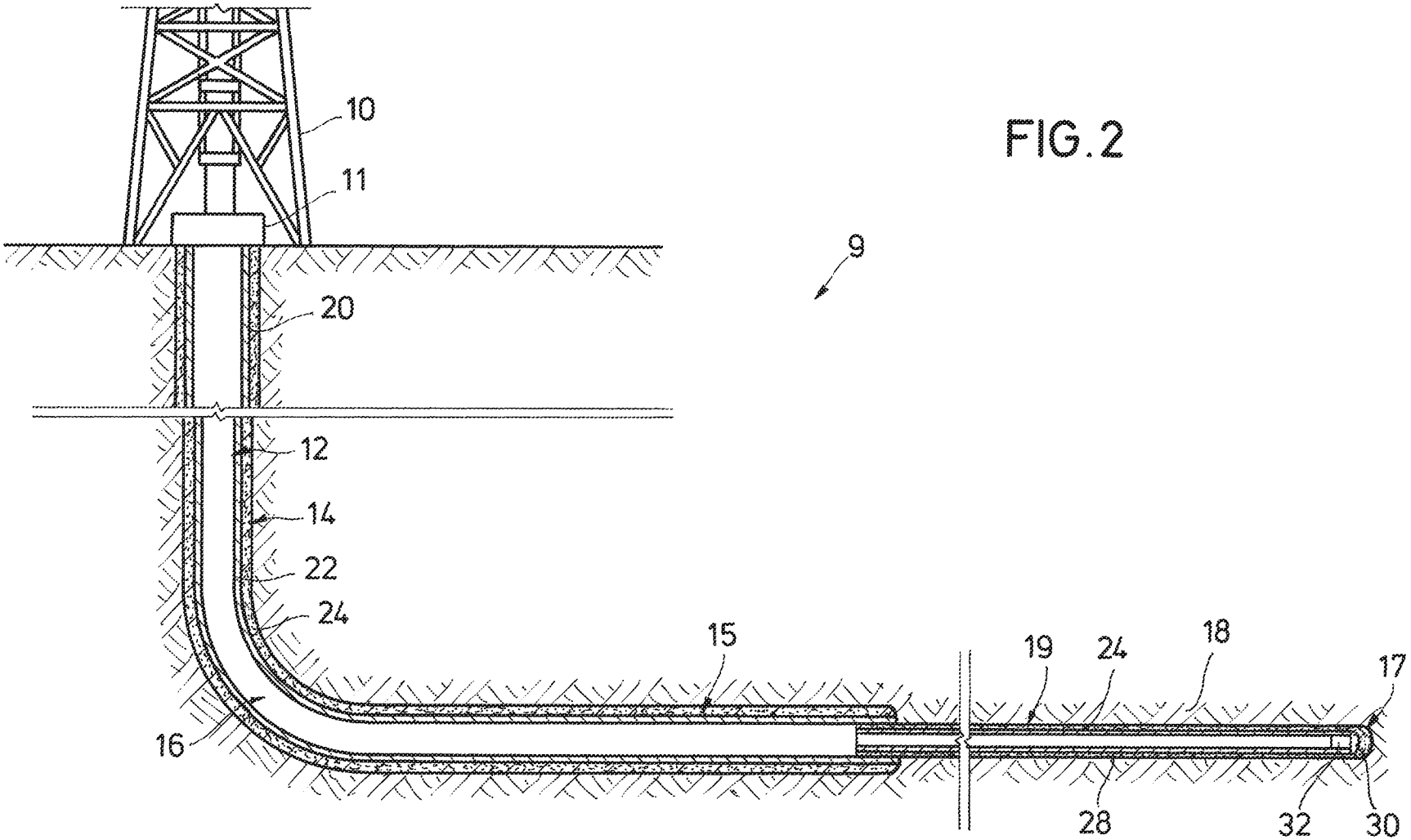
FIG. 2 is an elevation view in partial cross section of the well system of FIG. 1, showing a fully closed wellbore lined with surface, intermediate and production casing and a continuous cement sheath thereamong.

Referring to FIG. 2, well system 9 is shown during initial completion operations. A production casing string 28 has been run and cemented in the open hole portion 19 (FIG. 1) of wellbore 12 and attached to surface casing 20, if present, via intermediate casing 22. More specifically, production casing consist of multiple joints of pipe that are screwed together one joint at a time as they are run to the bottom of the hole (i.e., to total depth) through surface casing 20, and if present, intermediate casing strings 22. Production casing string 28 may be permanently set in the well by pumping concrete into the annular space between the casing and wall of the hole, in essentially the same manner as described above with respect to surface and intermediate casing strings 20, 22. A guide shoe 30 and float valve 32 are illustrated at the distal end of production casing 28 in FIG. 2.

As with surface and intermediate casing 20, 22, production casing 28: firstly, protects the hole from drilling mud, thereby preventing softer formations of shale from drawing water out of the mud, which can then cause the shale to swell and block or impede the drilling operations; secondly, prevents loose surface sediments and other unconsolidated formations from being eroded by the mud system; and thirdly, provides a smooth entryway and path for running tools into and out of the hole. Production casing 28 also performs an additional function; production casing 28, with its surrounding cement sheath 24, isolates downhole zones so that the different zones can more easily be produced separately. With production casing 28 installed and cement sheath 24 extant along the entire length of the wellbore, wellbore 12, from the top to the bottom, is now sealed off from the natural fluids and solids that exist in the subsurface in what is referred to as a closed hole or cased hole. In some instances, for example in an extended horizontal section, it may not be physically possible to run casing to the very bottom of the wellbore. In such cases, the remaining open hole may be filled with cement when cementing the production casing in place.

Figure 3:
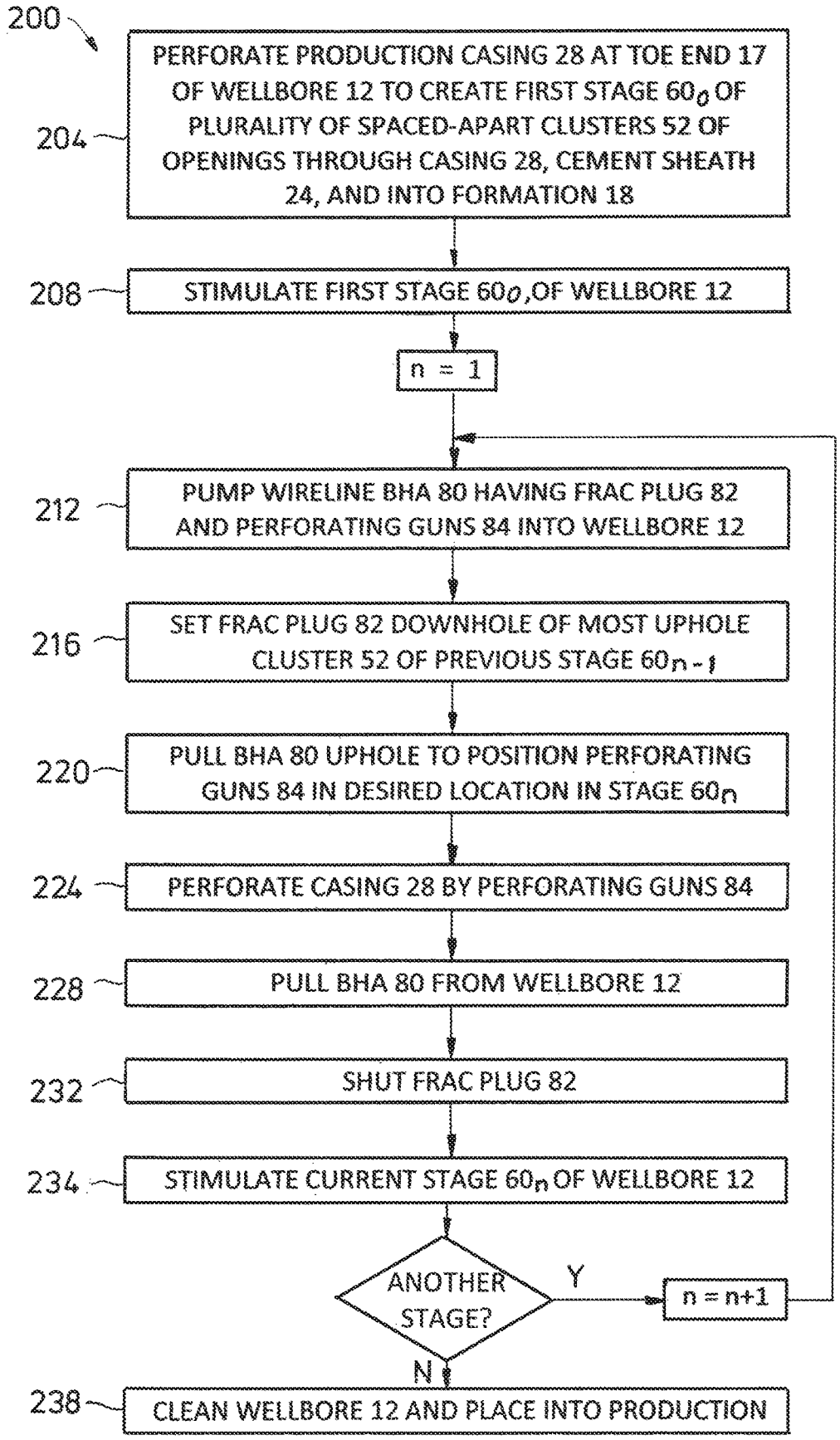
FIG. 3 is a flow chart of a method of well completion according to an embodiment for use with the well system of FIG. 2.
Figure 4:
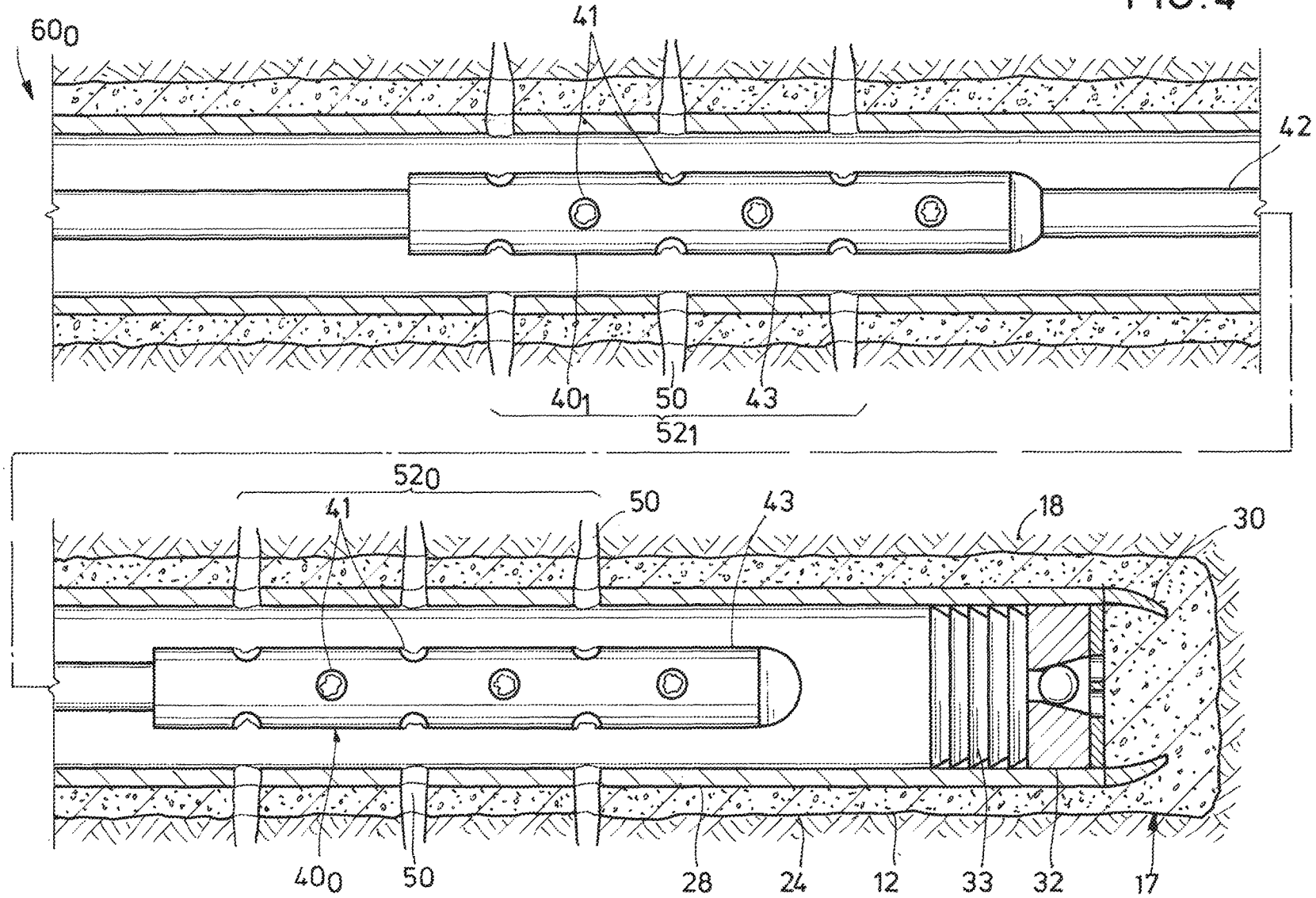
FIG. 4 is an elevation view in partial cross section of a toe end of the wellbore of FIG. 2 shown during initial perforation of a first stage according to the method of FIG. 3.

FIG. 3 is a flowchart of a method of well completion 200 according to one or more embodiments. FIG. 4 is an elevation view in partial cross-section of a portion of horizontal section 15 of wellbore 12, shown during a first stage of perforation operations according to the flowchart of FIG. 3. Referring now to FIGS. 3 and 4, production casing 28 and its surrounding cement sheath 24 has been initially installed. Guide shoe 30, float valve 32, and seal plug 33 are illustrated at toe 17. According to method 200, perforation of the first stage $\mathbf{60}_0$, and optionally stimulation and packing operations, is performed according to steps 204, 208 at toe 17 of wellbore 12.

Perforation entails creating openings 50 through production casing 28, cement sheath 24 and a short distance into the formation along pay zone 18. It is through openings 50 that hydrocarbon fluids will pass to the surface during subsequent well production. In one or more embodiments, at step 204, tubing-conveyed perforating (TCP) may be used to create the first stage $\mathbf{60}_0$ of perforations 50 at a first location near toe end 17 of wellbore 12. Because wellbore 12 at this stage of completion is a closed hole, perforators may not be pumped into wellbore 12. Moreover, perforators may not simply be lowered to toe end 17 through deviated or horizontal section 15 of wellbore 12. However, TCP allows perforating guns to be pushed into closed and highly deviated or horizontal holes that would be inaccessible to a wireline-conveyed gun. TCP may allow the most distal clusters of perforations to be located within inches or feet of toe end 17. TCP employs one or more perforating guns 40 that are conveyed by coiled tubing 42 to toe end 17 of wellbore 12. However, tractored wireline guns or toe initiation sleeves may be used in lieu of TCP according to one or more embodiments.

With tow initiation sleeves, depending on equipment size and configuration, the distal clusters of perforations may be located as within scores of feet (e.g., forty feet) from toe end 17. However, greater distances from toe end 17 to first stage $\mathbf{60}_0$ of perforations 50 may be used as operational requirements dictate.

Each perforating gun 40 may include a series of shaped charges (not illustrated) that are held within a hollow thin-walled charge tube (not illustrated). The charge tube, with shaped charges, is disposed within a cylindrical hollow steel carrier 43, typically constructed of high-strength steel, which may have thin, recessed scallops 41 formed in the wall that align with the shaped charges. Each shaped charge may include an outer charge case, an explosive compound, a metal liner defining a conical void at the jet end, and a detonator at the other end. Once perforating guns 40 are properly positioned in wellbore 12 adjacent to the formation to be perforated, the shaped charges may be detonated. At detonation, explosive energy is released normal to the surface of the explosive compound, thereby concentrating explosive energy in the void. Enormous pressure generated by detonation of explosive compound collapses the liner and fires a high-velocity jet of metal particles outward along the axis of the shaped charge, through the carrier, casing 28, cement sheath 24, and into formation 18.

In one or more embodiments, shaped charges and scallops 41 may be arranged in a linear configuration along the longitudinal length of each perforating gun 40, while in other embodiments, shaped charges and scallops 41 may be arranged in a helical configuration along the longitudinal length of perforating gun 40. For example, perforating guns $\mathbf{40}_0$ and $\mathbf{40}_1$ of FIG. 4 each include a helical arrangement, with six helical rows of paired shaped charges spaced 180 degrees apart, rotating 90 degrees per step. The arrangement and spacing of shaped charges may vary, but typically, perforations range between four to eight openings per cluster 52 (about 1-1.5 ft.). Typically but not necessarily, each stage 60 of perforations covers about two hundred feet of wellbore and includes from three to five equally spaced apart clusters 52. FIG. 4 exemplifies two separated perforating guns $\mathbf{40}_0$, $\mathbf{40}_1$ for producing two clusters $\mathbf{52}_0$, $\mathbf{52}_1$, respectively, of twelve perforations 50 each. It is to be understood, however, that the number and arrangement of perforations per cluster and the number and spacing of clusters per stage is basin specific and operator specific. For example, some wells may benefit from as many a twenty or more clusters, and some clusters may have as many as sixty or more holes.

In TCP, all shaped charges are typically all detonated simultaneously, actuated by applying a pressure within coiled tubing 42 from the surface. However, perforating guns 40 described herein are not limited to a particular type of arrangement, and the forgoing general comments are provided for illustrative purposes only.

In one or more embodiments, before first firing perforating guns 40, production casing 28 may be filled and pressurized with saltwater, called a water blanket or load brine. Thus, when the well is first perforated, the saltwater rushes out through the new perforations, killing the well and preventing a blowout. This is referred to as perforating in overbalanced conditions.

In other embodiments, with the potential for damaging the formation using overbalanced conditions, perforating may be performed in underbalanced conditions. Typically, the well will first be prepared for production by outfitting with production tubing, one or more packers, and a christmas tree (not illustrated) to provide the pressure control required for underbalanced perforating. Smaller-diameter production tubing may be hung from a tubing hanger (not illustrated) in wellhead 11 to extend down to production casing 28. A packer at the bottom of the tubing may seal between the production tubing and production casing 28 to protect the casing from the pressure and corrosive elements found in crude oil or gas. The christmas tree may be mounted atop wellhead 11 and includes a valve manifold that contains well pressure and controls flow through the production tubing.

TCP may also be used for underbalanced perforating in a fully equipped well. In this case, perforating guns 40 of a diameter smaller than the production tubing may enter the well through the crown valve and stuffing box or lubricator of the christmas tree and be run through the production tubing into production casing 28 below the packer. With packers and the christmas tree in place, the fluid level in production casing 28 can then be kept low so that that that the hydrostatic pressure is less than the formation pressure. The stuffing box contains well pressure to prevent blowouts. Formation pressure causes formation fluid ingress into the wellbore upon perforation, thereby flushing out the jet charge debris and damaged formation rock.

Figure 5:
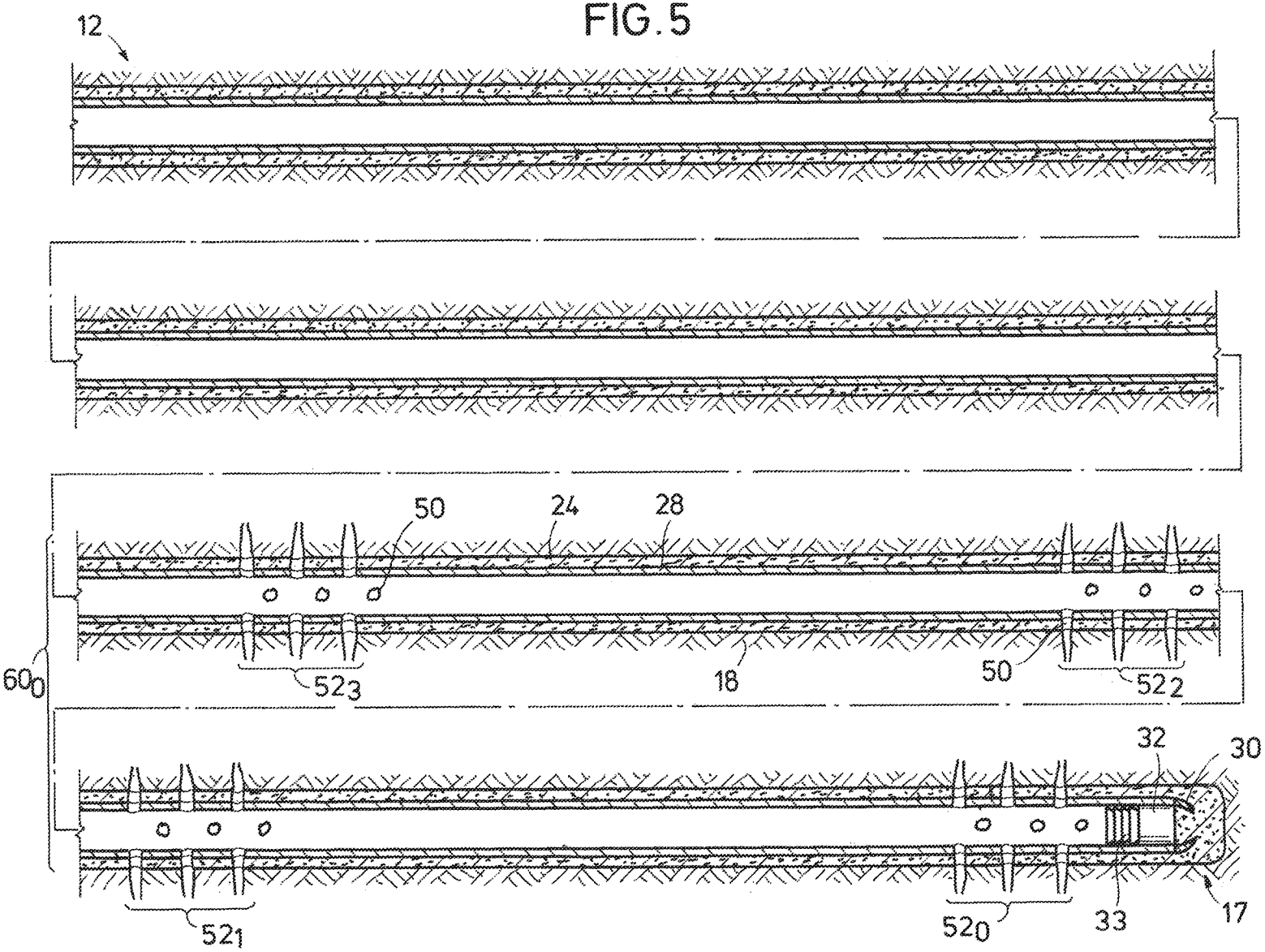
FIG. 5 is an elevation view in cross section of the toe end of the wellbore of FIG. 2 after perforation of the first stage according to the method of FIG. 3, showing multiple spaced-apart clusters of perforations along the first stage.

After perforating first stage $\mathbf{60}_0$ at step 204, perforating guns 40 are pulled from wellbore 12. FIG. 5 is an elevation view in cross-section of toe end 17 of wellbore 12, shown following perforation of first stage $\mathbf{60}_0$ and prior to stimulation according to step 208 of method 200.

FIG. 5 illustrates first stage $\mathbf{60}_0$ having four clusters $\mathbf{52}_0$-$\mathbf{52}_3$ of perforations 50, each separated from the others by a preselected distance. However, other numbers of clusters may be used in a given stage according to well and formation parameters. Referring to FIGS. 3 and 5, after perforating the first, distal stage $\mathbf{60}_0$ at step 204, pay zone 18, if a low permeability zone, may be stimulated at step 208 to provide the reservoir fluid better access to wellbore 12 so that an adequate production or flow rate of hydrocarbons may be attained. In stimulation operations, which may include matrix acidizing, hydraulic fracturing, and fracturing acidizing, treating fluids are pumped into the well, out through perforations 50, and into formation 18.

In hydraulic fracturing, the treating fluid is introduced into the formation under high pressure to break down the formation in controlled fractures. The treating fluid may include gelling chemicals to increase viscosity and enable increased pressure to be evenly distributed across pay zone 18 to facilitate fracturing. A propping agent, for example, large rounded sand grains, may be introduced into the gelled fluid being pumped. Because of the high viscosity or turbulence of the treating fluid, the proppant remains suspended evenly throughout the solution as it is pumped into the fractures. Proppant holds the fractures open after stimulation pressure is removed, forming a high-volume flow path for oil and gas. In matrix acidizing, one or more acid solutions may be used to increase the number of fractures. The acid is slowly pump down the wellbore and out through the matrix of the reservoir while taking care that no undue pressure is exerted on the reservoir rock that might cause the formation to fracture in unproductive ways. Fracture acidizing is a combination of matrix acidizing and hydraulic fracturing. Acid is injected at a high enough pressure in order to fracture the formation. As the pressure of the pumped acid extends the fractures, the acid chemically etches irregular surfaces in the fractures, which leaves a high-volume flow channel to the wellbore.

If needed, the zone can also be gravel packed at this stage to minimize sand production, either as a separate operation or in combination with fracturing, known as frac-packing. In gravel packing, a screen is run into the hole on tubing with a crossover packer that allows the fluids to cross over from the tubing to the annulus and back again. The gravel is mixed with gelled water and then pump down the tubing through the crossover packer into the annulus. The gelled water passes through the interior of the screen, crosses over in the packer into the annulus, and circulates to the surface, but the gravel is filtered out by the screen. The gravel accumulates in the annulus and operates to filter out the sand during production. In frac-packing, the packing fluid is injected at a rate sufficient to build up pressure and fracture the formation. Pumping continues as the gravel is packed into the formation.

Figure 6:
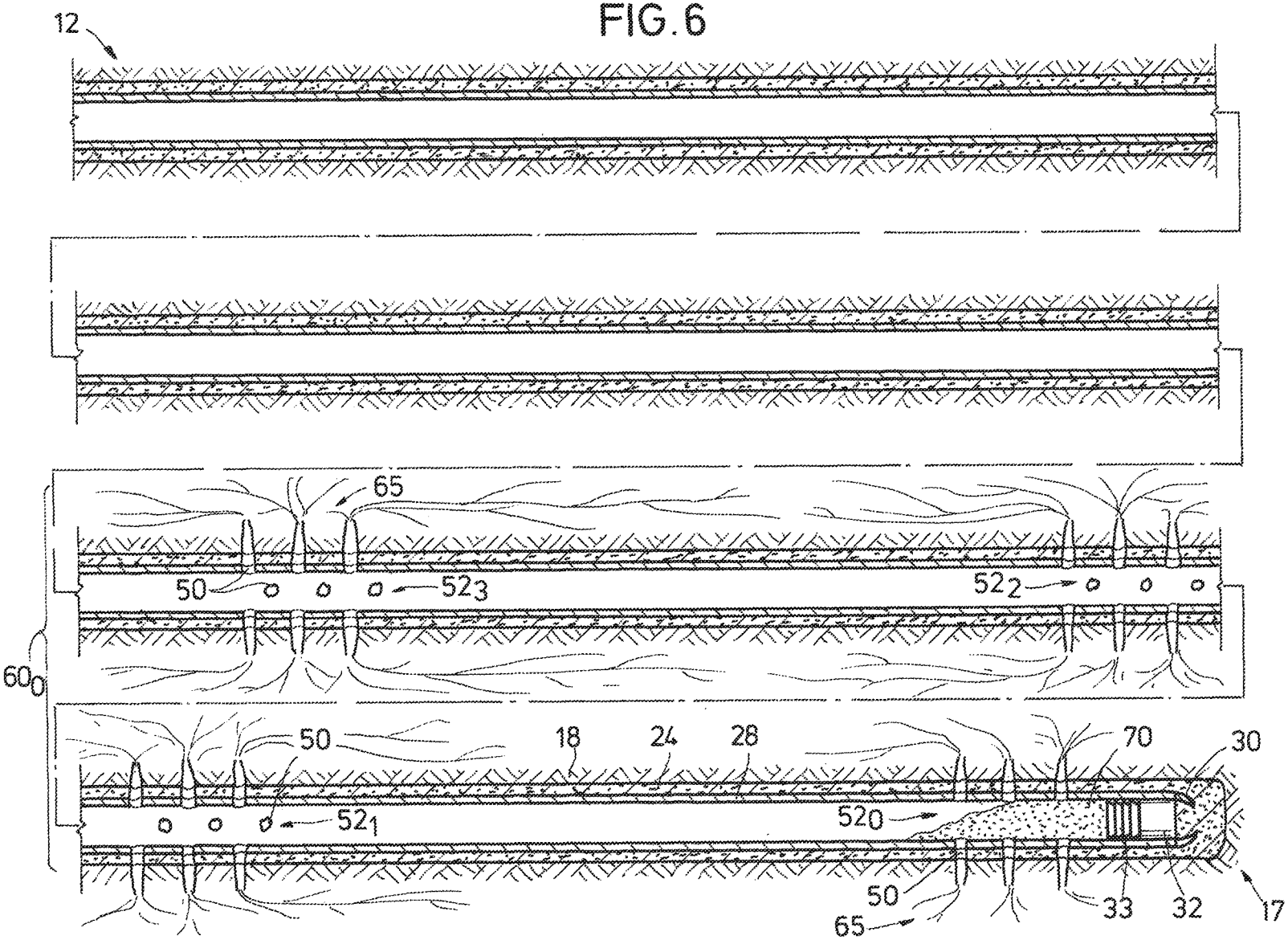
FIG. 6 is an elevation view in cross section of the wellbore of FIG. 5 after stimulation operations according to the method of FIG. 3, showing first stage clusters with fracturing of varied efficacy and accumulation of proppant within the wellbore.

FIG. 6 is an elevation view in cross-section of toe end 17 of wellbore 12, shown after the stimulation operations of first stage $\mathbf{60}_0$ according to step 208 of method 200 outlined in the flowchart of FIG. 3. Substantial fractures 65 have been formed throughout pay zone 18. However, as illustrated, it has been observed in practice that in certain hydraulic fracturing operations, the formation at the more proximal uphole clusters 52 (i.e., those closest to wellhead 11 (FIG. 2)) exhibits a tendency to breakdown more than at the most distal clusters 52 (i.e., those closest to toe 17). The distal clusters with low flow may not absorb much of the proppant, with the undesirable result that proppant (e.g., sand) accumulates in the wellbore below the uphole clusters exhibiting dominant flow. FIG. 6 illustrates this phenomenon, with proximal cluster $\mathbf{52}_3$ exhibiting significant fracturing, medial clusters $\mathbf{52}_2$, $\mathbf{52}_1$ exhibiting less fracturing, and most distal cluster $\mathbf{52}_0$ showing little fracturing. An accumulation of proppant 70 has collected at toe end of wellbore 12 and substantially blocks perforations 50 of cluster $\mathbf{52}_0$.

After stimulation of first stage $\mathbf{60}_0$, perforation and stimulation operations may continue, stage-by-stage, working uphole as the process repeats. A process colloquially referred to as "plug & perf" may be used to run a frac plug along with perforating guns. Because wellbore 12 is no longer a closed hole (i.e., perforations 50 of first stage $\mathbf{60}_0$ open into the formation), the frac plug and the desired number and arrangement of perforating guns may be run as a wireline bottom hole assembly (BHA). Pumping may be used to push the BHA through lateral portion 15 (FIG. 2) of wellbore 12 to the stage to be completed.

Figure 7:
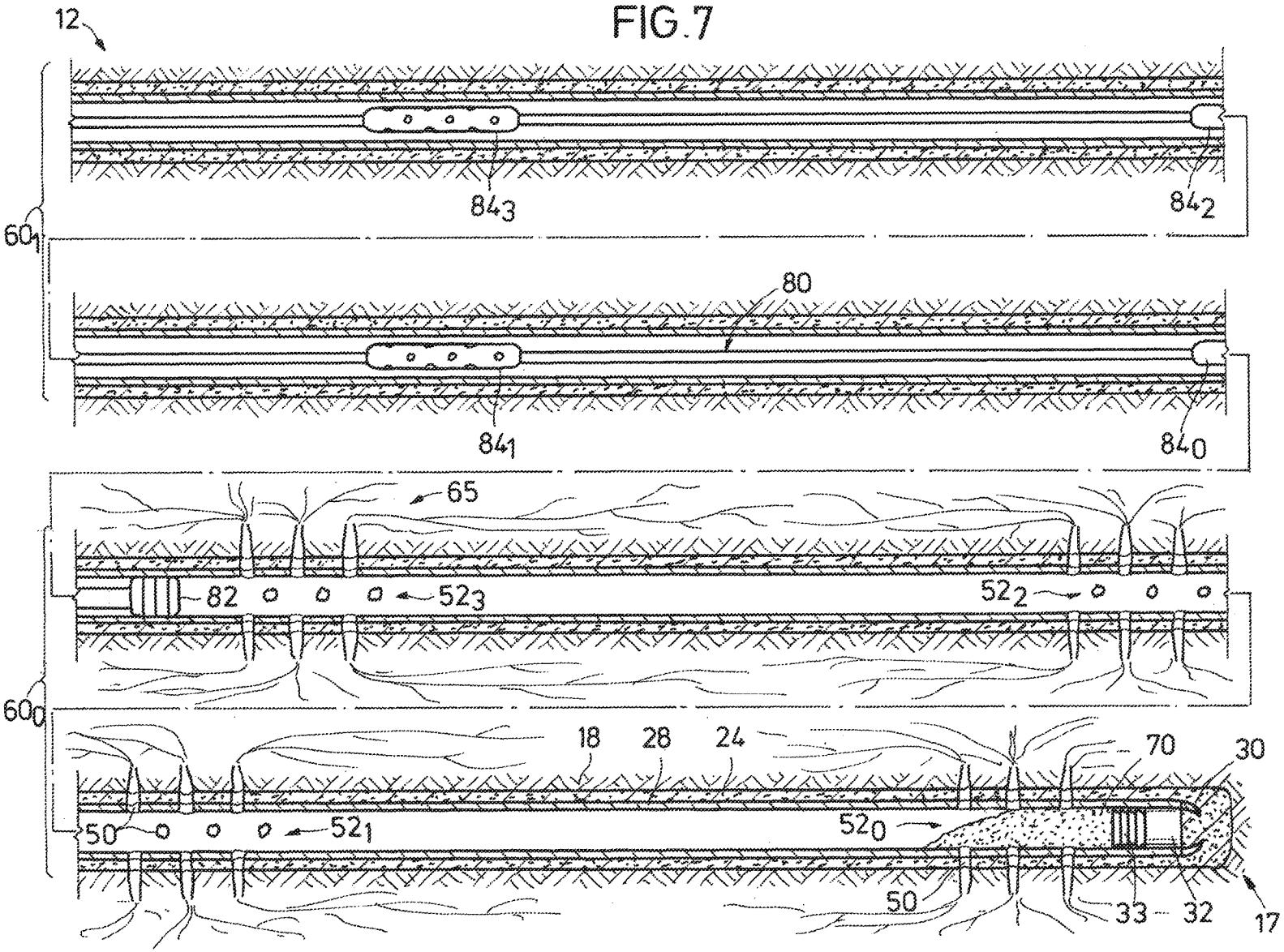
FIG. 7 is an elevation view in partial cross section of first and second stages of a wellbore during conventional plugging and perforating operations, showing a bottom hole assembly with frac plug and perforating guns setting the frac plug uphole of the most proximal first stage cluster.
Figure 8:
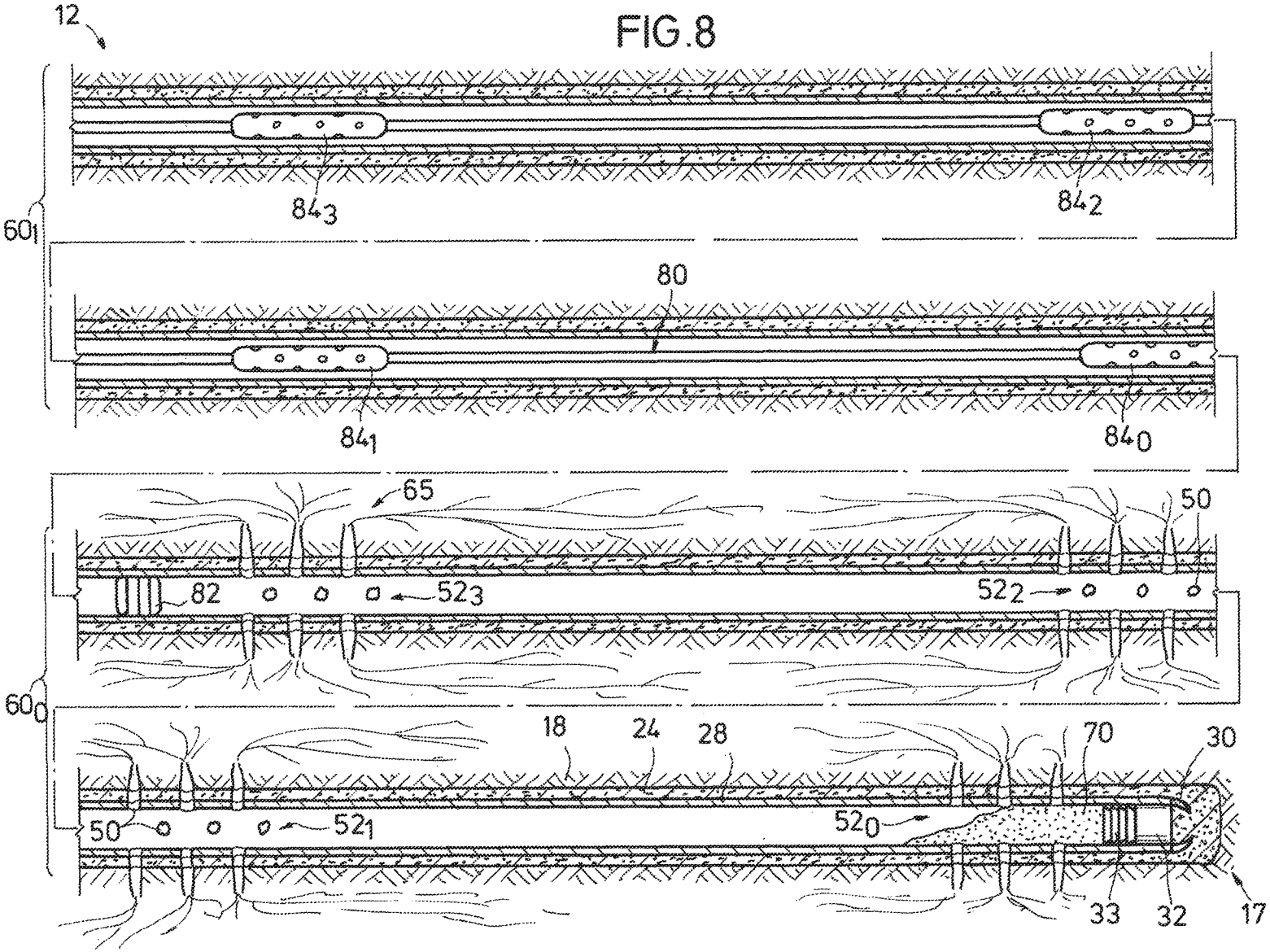
FIG. 8 is an elevation view in partial cross section of the wellbore of FIG. 7 during conventional plugging and perforating operations, showing the bottom hole assembly being pulled uphole to position the perforating guns after having set the frac plug.
Figure 9:
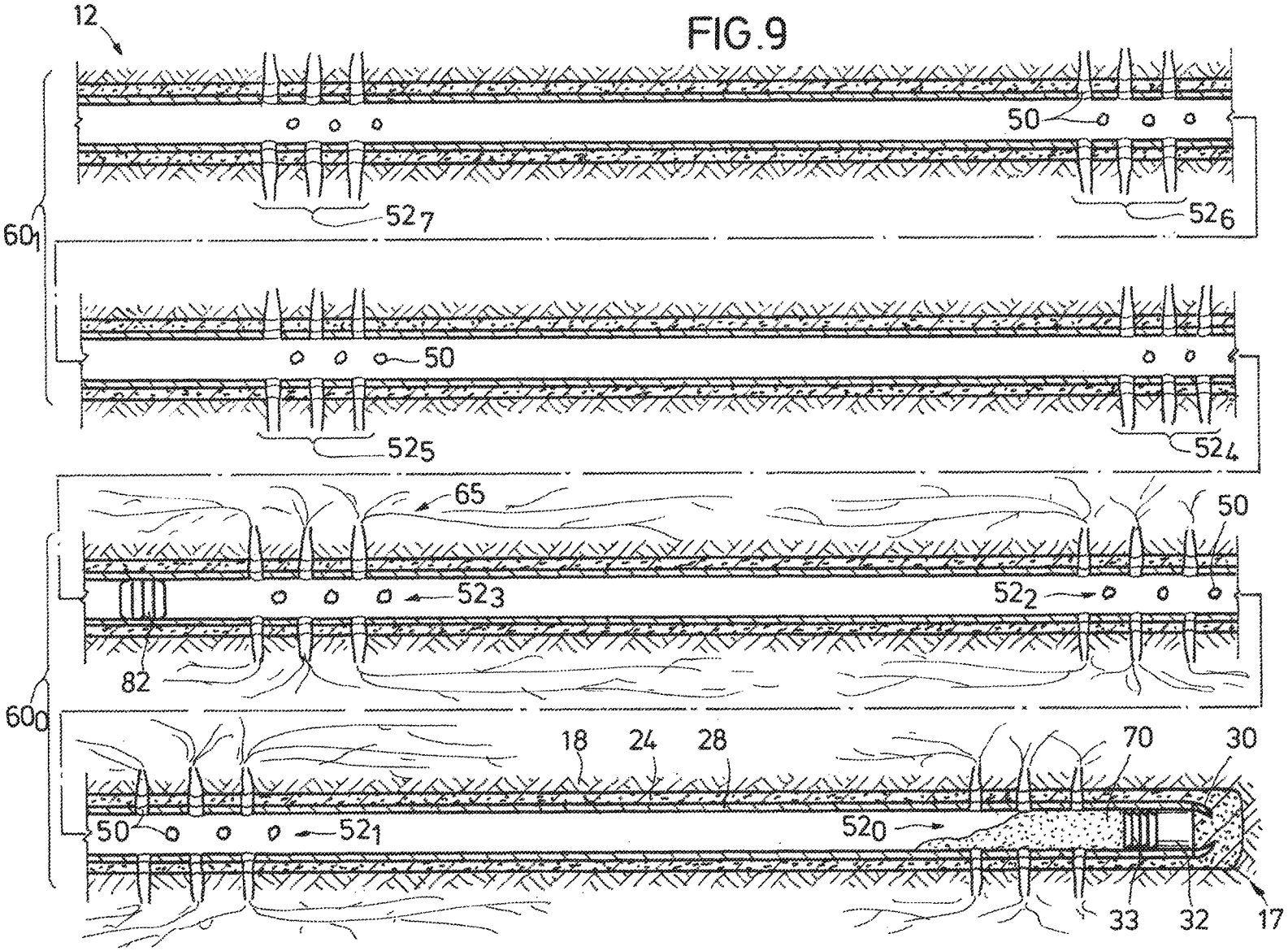
FIG. 9 is an elevation view in cross section of the wellbore of FIG. 8 during conventional plugging and perforating operations, showing the wellbore after having perforated the second stage.

FIGS. 7-9 illustrate a conventional plug & perf operations for a second stage $\mathbf{60}_1$. Referring to FIG. 7, wireline BHA 80, with a deployable or settable frac plug 82 and perforating guns 84 (four guns $\mathbf{84}_0$-$\mathbf{84}_3$ are shown, but any suitable number and/or type of perforating guns 84 may be used as appropriate) is pumped into wellbore 12 to a position where frac plug 82 is disposed uphole of the most proximal cluster $\mathbf{52}_3$ of the first stage $\mathbf{60}_0$. Frac plug is set into wellbore 12, for fluidly isolating (e.g., in a subsequent operation, after a ball has been flowed into the wellbore and is seated on the frac plug) first stage $\mathbf{60}_0$ of wellbore 12 from second stage $\mathbf{60}_1$, and then released from BHA 80. As shown in FIG. 8, BHA 80 may then be pulled uphole until perforating guns 84 are located at the desired positions for perforating production casing 28. At this point, using wireline control, the shaped charges of perforating guns 84 may be detonated, either in over- or underbalanced conditions, to create spaced-apart clusters $\mathbf{52}_4$-$\mathbf{52}_7$, respectively, of openings 50 through production casing 28, cement sheath 24, and into the formation, as shown in FIG. 9. BHA 80 may then be tripped from wellbore 12, leaving frac plug 82 in place for subsequent stimulation operations.

Figure 10:
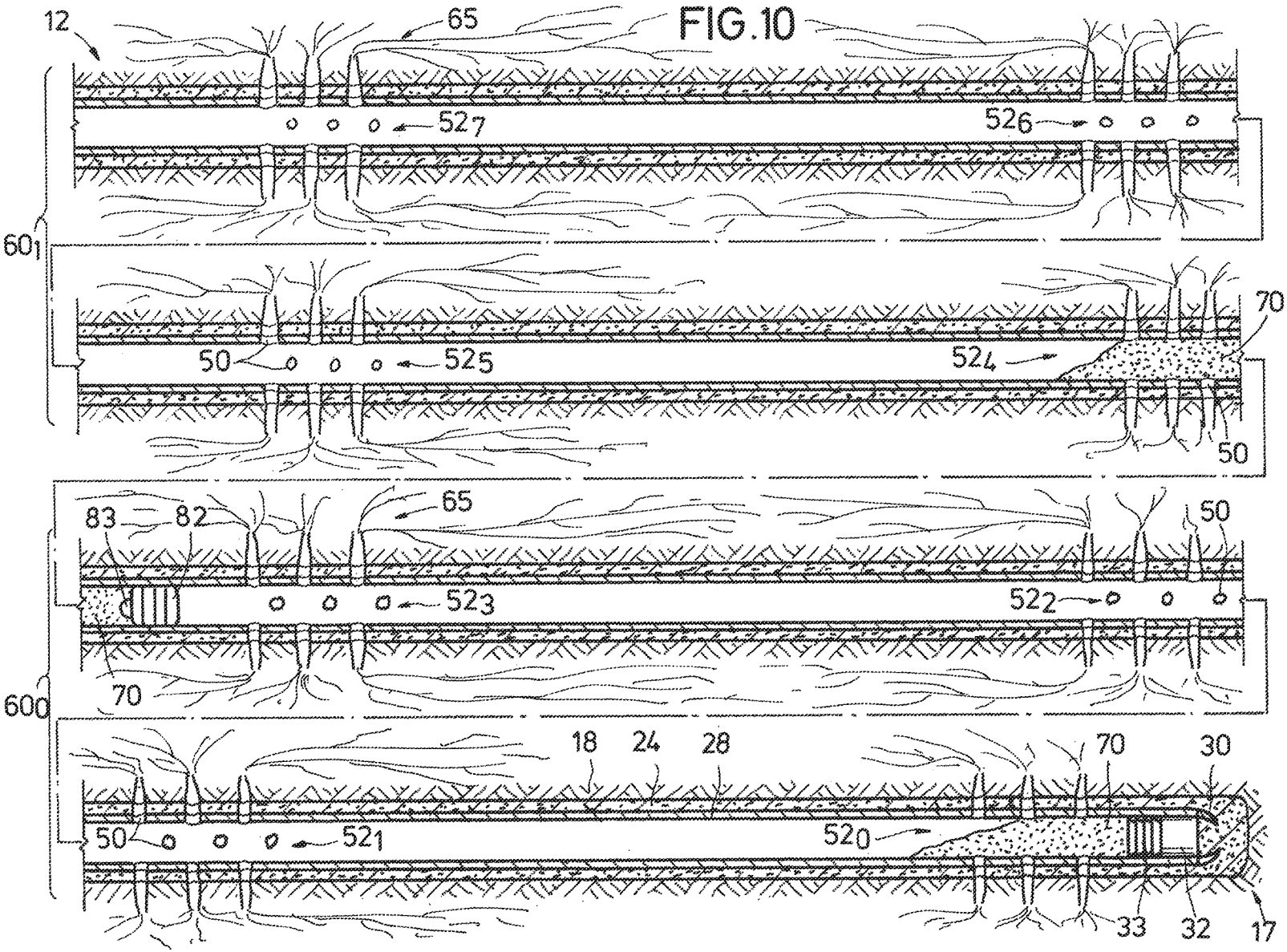
FIG. 10 is an elevation view in cross section of the wellbore of FIG. 9 after having performed conventional fracturing operations, showing second stage clusters with fracturing of varied efficacy and accumulation of proppant within the second stage of the wellbore uphole of the frac plug.

FIG. 10 illustrates results of a hydraulic fracturing operation as typically performed on second stage $\mathbf{60}_1$. The treating fluid is introduced into the formation at second stage $\mathbf{60}_1$ under high pressure to break down the formation in controlled fractures. A ball 83 may first be flowed into wellbore 12 to land and seat against frac plug 82, thereby isolating first stage $\mathbf{60}_0$ of wellbore 12 from second stage $\mathbf{60}_1$ to facilitate pressurization of wellbore 12. Alternatively, frac plug 82 may include a caged ball (not expressly illustrated) that acts as a one-way check valve without the need for flowing a ball into the wellbore.

As with first stage $\mathbf{60}_0$, the formation at the more proximal uphole clusters 52 (i.e., those closest to wellhead 11 (FIG. 2)) exhibits a tendency to breakdown more than the most distal clusters 52 (i.e., those closest to toe 17). The distal clusters with low flow may not absorb much of the proppant, with the undesirable result that proppant (e.g., sand) accumulates in the wellbore below the uphole clusters exhibiting dominant flow. FIG. 10 illustrates this phenomenon at second stage $\mathbf{60}_1$, with proximal cluster $\mathbf{52}_7$ exhibiting significant fracturing, medial clusters $\mathbf{52}_6$, $\mathbf{52}_5$ exhibiting less fracturing, and most distal cluster $\mathbf{52}_4$ of second stage $\mathbf{60}_1$ showing little to no fracturing. An accumulation of proppant 70 has collected atop frac plug 82 and substantially blocks perforations 50 of cluster $\mathbf{52}_4$.

Figure 11:
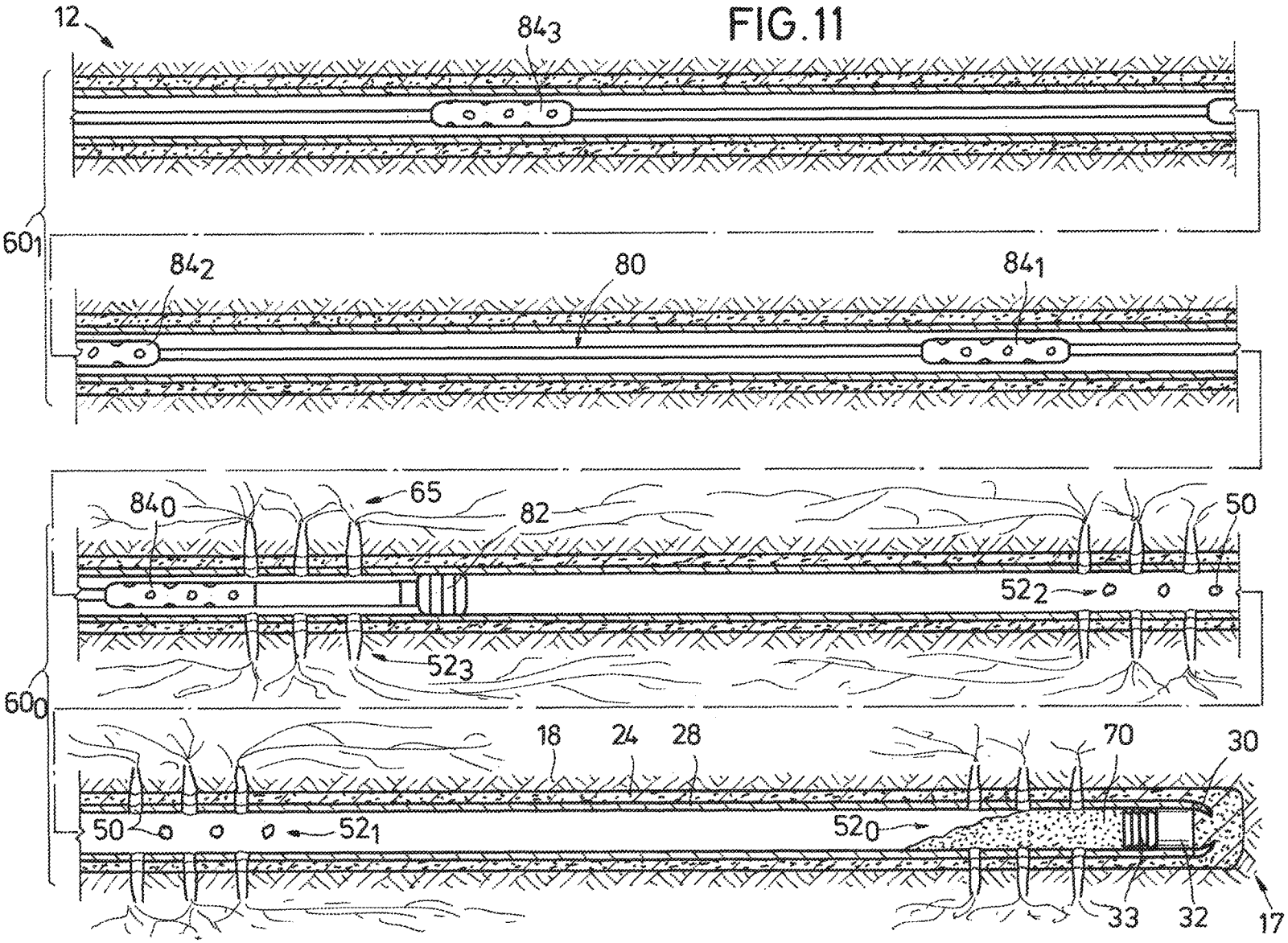
FIG. 11 is an elevation view in partial cross section of first and second stages of the wellbore of FIG. 6 during plugging and perforation operations according to the method of FIG. 3, showing a bottom hole assembly with frac plug and perforating guns setting the frac plug downhole of the most proximal first stage cluster.
Figure 12:
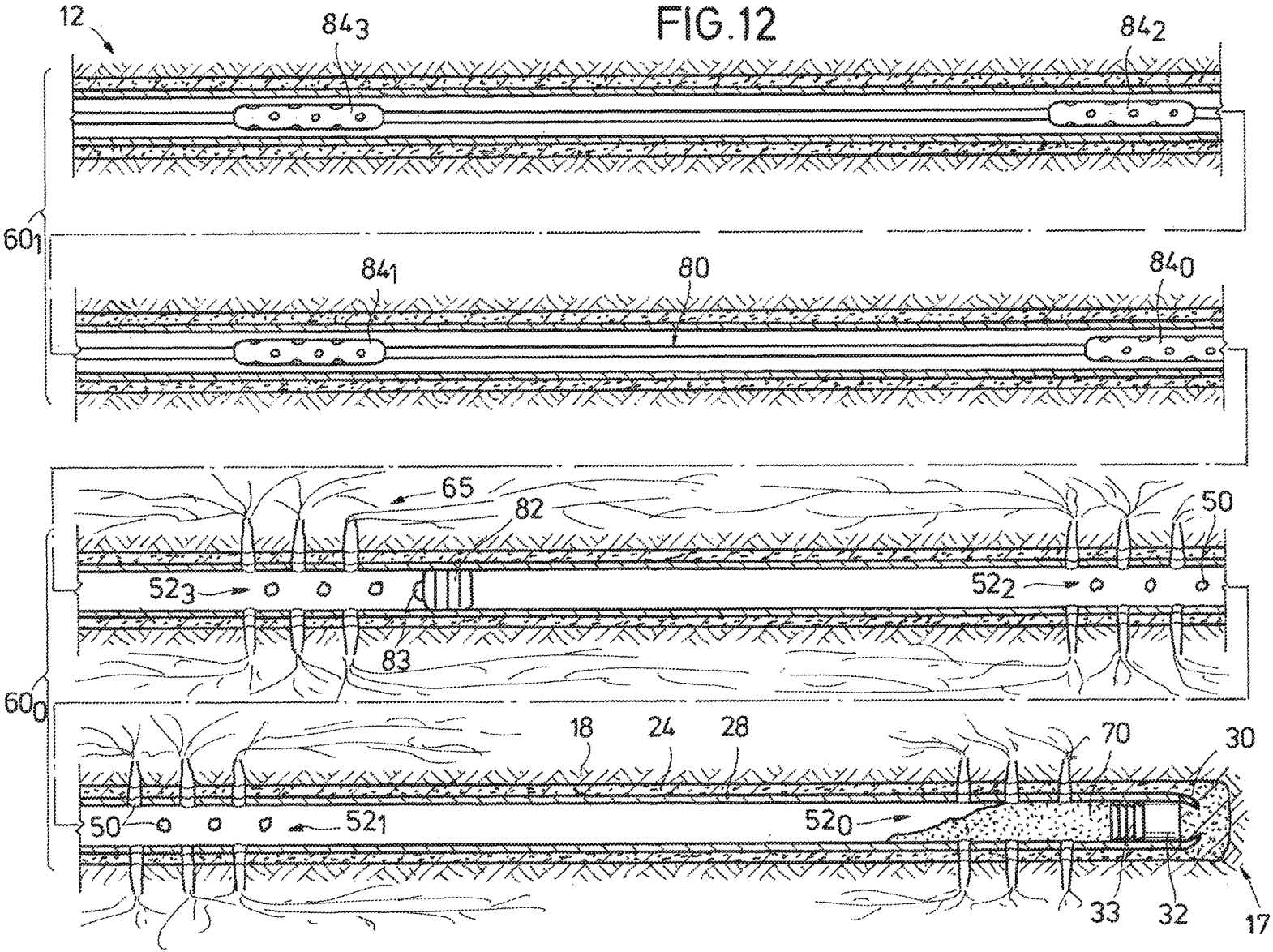
FIG. 12 is an elevation view in partial cross section of the wellbore of FIG. 11 during plugging and perforating operations according to the method of FIG. 3, showing the bottom hole assembly being pulled uphole to position perforating guns after having set the frac plug.
Figure 13:
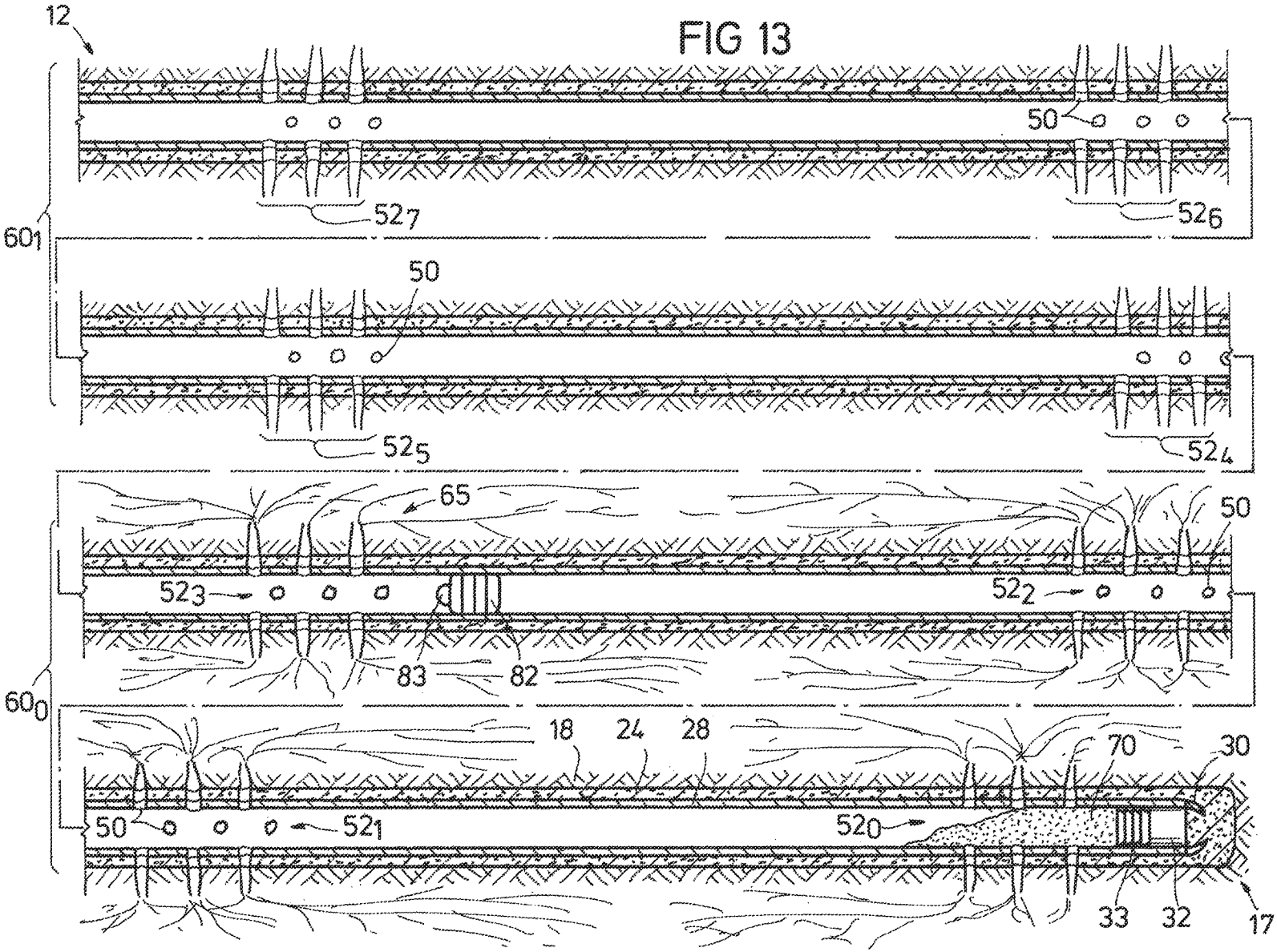
FIG. 13 is an elevation view in cross section of the wellbore of FIG. 12 during plugging and perforation operations according to the method of FIG. 3, showing the wellbore after having perforated the second stage.

In contrast, according to one or more embodiments, after stimulation of first stage $\mathbf{60}_0$ at step 208, perforation and stimulation operations may continue, stage-by-stage ($\mathbf{60}_n$, $\mathbf{60}_{n+1}$, $\mathbf{60}_{n+2}$, . . . ) by repetitively performing steps 212-234 of method 200, working uphole as the process repeats. FIGS. 11-13 illustrate improved plug & perf operations according an embodiment and as set forth in the flowchart of FIG. 3, as applied to completion of a second stage $\mathbf{60}_1$ (n=1). Referring to FIGS. 3 and 11, at step 212, wireline BHA 80, with frac plug 82 and perforating guns 84, is pumped into wellbore 12 to a position where frac plug 82 is disposed just downhole of the most proximal cluster $\mathbf{52}_3$ of the first stage $\mathbf{60}_0$. At step 216, frac plug is set into wellbore 12, for fluidly isolating second stage $\mathbf{60}_1$ of wellbore 12 from the remainder of clusters $\mathbf{52}_0$-$\mathbf{52}_2$ of first stage $\mathbf{60}_0$, and then released from BHA 80.

Referring to FIGS. 3, 12, and 13, at step 220, BHA 80 may then be pulled uphole until perforating guns 84 are located at the desired positions for perforating production casing 28. Next, at step 224, using wireline control, the shaped charges of perforating guns $\mathbf{84}_0$-$\mathbf{84}_3$ may be detonated, either in over- or underbalanced conditions, to create spaced-apart clusters $\mathbf{52}_4$-$\mathbf{52}_7$, respectively, of openings 50 through production casing 28, cement sheath 24, and into formation 18. Although four clusters $\mathbf{52}_4$-$\mathbf{52}_7$ are illustrated as being formed by four perforating guns $\mathbf{84}_0$-$\mathbf{84}_3$, any number of perforating guns 84 may be provided to produce any corresponding number of clusters per stage 60. Additionally, plug & perf systems other than wireline may be used if desired. At step 228, BHA 80 may be tripped from wellbore 12, with frac plug 82 being left in place for subsequent stimulation operations.

Completion method 200, in particular plug & perf steps 212-224, allows for the use of caged-ball frac plugs for zonal isolation with less risk than if used with the conventional plug & perf operations of FIGS. 7-9. Caged-ball frac plugs provide an advantage of fluid savings and time savings due to not having to pump down a ball prior to starting hydraulic fracturing operations for a given stage. Despite this advantage, caged-ball frac plugs are often avoided due to the closed system scenario that would occur if a plug was set normally but the perforation guns failed to fire properly. In such a situation, the defective BHA could be pulled out of the wellbore, but a subsequent pump down of a BHA with fresh perforating guns cannot be performed, because the wellbore now defines a closed system. Such a scenario would necessitate the use of TCP or the like, incurring concomitant cost. However, according to method 200, use of the caged-ball frac plug is less risky, because wellbore 12, open to the most proximal cluster of the previous stage after the plug is set, is not a closed system, thereby allowing pumping of wireline perforating guns or other tools.

Figure 14:
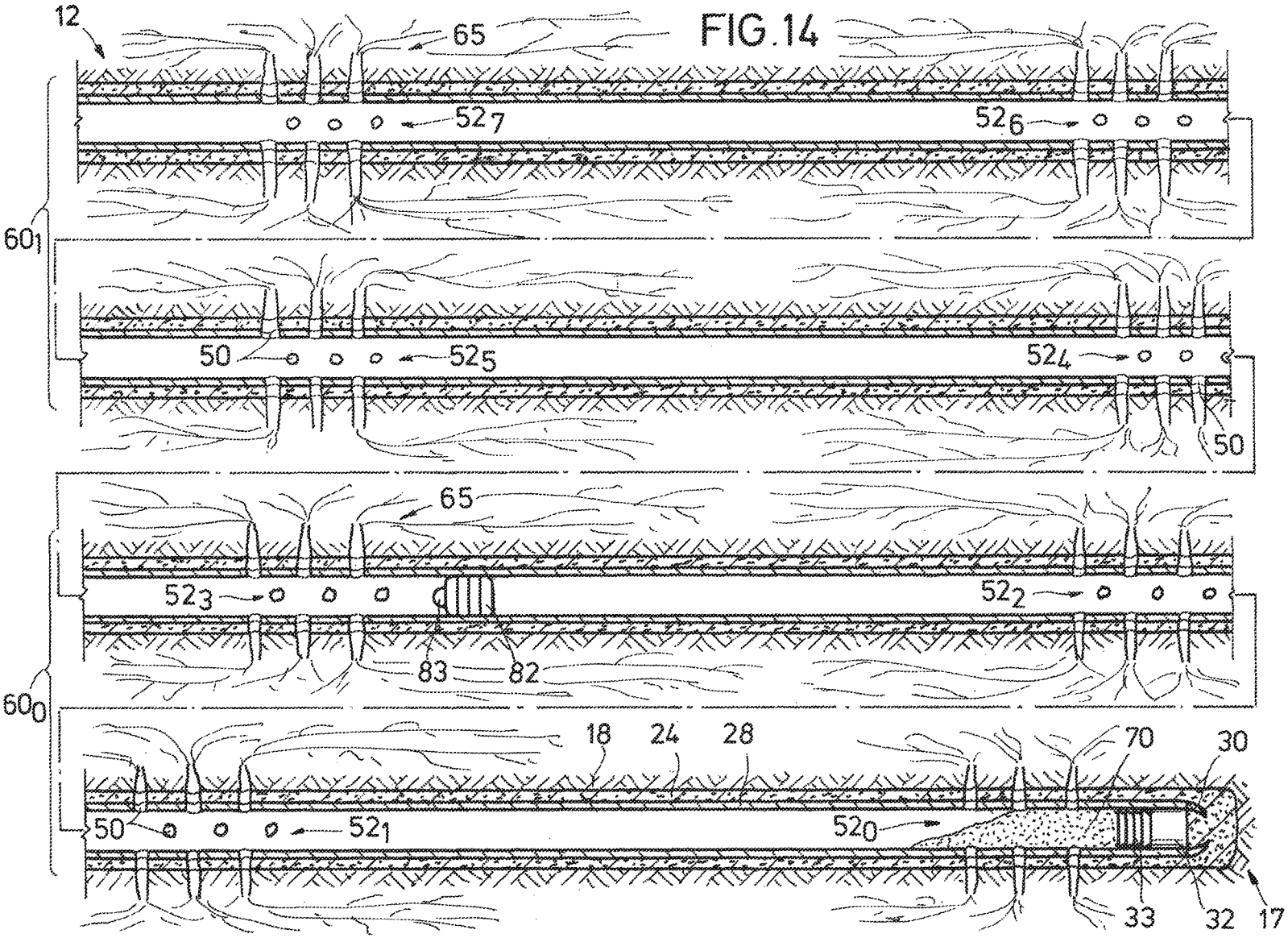
FIG. 14 is an elevation view in cross section of the wellbore of FIG. 12 after having performed fracturing operations according to the method of FIG. 3, showing no accumulation of proppant within the second stage of the wellbore.

At step 232, ball 83 may be flowed into wellbore 12 to land and seat against frac plug 82, thereby isolating second stage $\mathbf{60}_1$ of wellbore 12 from all but the most proximal cluster $\mathbf{52}_3$ in first stage $\mathbf{60}_0$ to facilitate pressurization of wellbore 12. Alternatively, frac plug 82 may include a caged ball (not expressly illustrated) that acts as a one-way check valve to shut upon pressurization of the uphole side. At step 234, treating fluid is introduced into the formation at second stage $\mathbf{60}_1$ under high pressure to break down the formation in controlled fractures 65. FIG. 14 illustrates results of a hydraulic fracturing operation performed on second stage $\mathbf{60}_1$ according to method 200 of FIG. 3.

Conventional plugging and perforating procedures, as illustrated in FIGS. 7-10, attempt to maintain full isolation from the previous stage by placing frac plug 82 uphole of the previous completion stage's most proximal perforation cluster 52. In contrast, method 200, as illustrated in FIGS. 3 and 11-14, does not maintain full isolation between stages but leaves the current stage in communication with the most proximal perforation cluster 52 of the previous completion stage. As with first stage $\mathbf{60}_0$, there may still remain a slight preference for the most proximal clusters 52 (i.e., those closest to the wellhead) to breakdown first and preferentially take the frac treatment. It is posited, however, that by leaving a cluster from the previously stimulated stage exposed during the new treatment stage, the treatment fluid may have a preference to treat the most distal cluster, which may influence the breakdown of the remaining uphole clusters and positively impact stimulation across the current stage overall.

Regardless of the efficacy of stimulation of clusters 52 of the current stage 60, method 200 may substantially reduce the volume of proppant 70 settling in wellbore 12 compared to the conventional completion operations of FIGS. 7-10. Method 200 promotes a high likelihood of fluid flow across the entire length of the current stage 60 during stimulation, as compared to a situation in which flow to distal clusters 52 is hindered due to the most proximal clusters taking the majority of the treatment fluid. Method 200 also reduces the no- or low-flow zone distance in a stage 60, in which there is a higher probability for proppant 70 settle out of solution out and accumulate in wellbore 12. Accordingly, as compared to FIG. 10, FIG. 14 shows negligible accumulation of proppant 70 in second stage $\mathbf{60}_1$ from stimulation operations. Aside from the benefits of a cleaner wellbore, minimizing the amount of proppant 70 that remains in lateral portion 15 of wellbore 12 during completion operations may facilitate development of dissolvable plug technologies that that may eliminate requirements for a wellbore cleanout after the completion operations.

According to one or more embodiments, another advantage of method 200 is the ability to attempt breakdown of certain perforation clusters near the toe-side of the stage to give them preferential acceptance of the stimulation treatment once pumping begins. Preferential stimulation could be especially advantageous in a completion utilizing diversion tactics, where initial breakdown of all clusters could be counterproductive. The selective breakdown of the toe-side clusters could be achieved by perforating a first portion of a stage 60, pumping a volume treatment fluid to help breakdown the newly perforated clusters, and then perforating final portions of the stage before proceeding on to the hydraulic fracturing treatment. A caged-ball frac plug may be used in such an operation.

Referring back to FIG. 3, steps 212-234 may be repeated for each additional stage $\mathbf{60}_n$ to complete, overlapping one or more of the most proximal perforation clusters 52 of the previous stage $\mathbf{60}_{n-1}$ with each subsequent plug & perf run. When all stages in pay zone 18 have been completed as above, at step 238, wellbore 12 may be cleaned and placed into production in a conventional manner.

In summary, methods to perform wellbore completion operations have been described. Embodiments of a method to perform wellbore completion operations may generally include: perforating a production casing at a first location nearest a toe end of a wellbore to create a first stage of a plurality of spaced-apart clusters of perforations through the casing; plugging the wellbore at a first plug location between at least a most uphole first and a second of the plurality of clusters of the first stage; and then perforating the casing at a second location uphole of the first stage to create a second stage of a plurality of spaced-apart clusters of perforations through the casing into the formation. Embodiments of a method to perform wellbore completion operations may generally include: running a first perforating gun to a first location nearest a toe end within a wellbore; actuating the first perforating gun to create an initial stage of a plurality of spaced-apart clusters of perforations through the casing thereby opening the wellbore to a formation; running a bottom hole assembly carrying a second perforating gun and a deployable plug into the wellbore to a second location uphole of the initial stage; deploying the plug to isolate the wellbore between at least a most uphole first and a second of the plurality of clusters of the initial stage; and actuating the second perforating to create a second stage of a plurality of spaced-apart clusters of perforations through the casing into the formation. Embodiments of a method to perform wellbore completion operations may also generally include: repetitively perforating and plugging a production casing in stages along a wellbore including, for each stage, perforating the casing along a current stage to create a plurality of spaced-apart clusters of openings through the casing, and plugging the wellbore between at least a most uphole first and a second of the plurality of clusters of a previously perforated stage.

Any of the foregoing embodiments may include any one of the following elements or characteristics, alone or in combination with each other: stimulating the formation at the second stage; the first of the plurality of clusters of the first stage maintains fluid flow past each of the clusters of the second stage into the formation during the stimulating; the wellbore is a closed hole prior the perforating the first stage; the perforating the first stage opens the wellbore to a formation; the wellbore remains open after the plugging; perforating the first stage using with a tubing-conveyed perforating gun; providing a wireline bottom hole assembly having a settable plug and a perforating gun; pumping the bottom hole assembly to the second location; plugging the wellbore at the first plug location with settable plug by the bottom hole assembly; perforating the second stage using the perforation gun; the settable plug includes a caged ball; after the plugging the wellbore at the first plug location, pumping a tool into the wellbore; plugging the wellbore between at least a most uphole first and a second of the plurality of clusters of the second stage; perforating the casing at a third location uphole of the second stage to create a third stage of a plurality of spaced-apart clusters of perforations through the casing into the formation; stimulating the formation at the third stage; the first of the plurality of clusters of the second stage maintains fluid flow past each of the clusters of the third stage into the formation during the stimulating of the third stage; stimulating the formation at the second stage; the first of the plurality of clusters of the first stage maintains fluid flow past each of the clusters of the second stage into the formation during the stimulating; the wellbore is a closed hole prior the actuating the first perforating gun; the actuating the first perforating gun opens the wellbore to a formation at the first stage; the wellbore remains open after the deploying the plug; conveying the first perforating gun by coiled tubing; running the bottom hole assembly by pumping the bottom hole assembly through the wellbore; the plug includes a caged ball; after the deploying the plug, pumping a tool into the wellbore; selectively actuating the second perforator while the second perforator is pulled uphole to create the second stage of a plurality of spaced-apart clusters of perforations through the casing into the formation; stimulating the formation at the current stage; the first of the plurality of clusters of the previous stage maintains fluid flow past each of the clusters of the current stage into the formation during the stimulating; providing a plug and a perforating gun; pumping the plug and the perforating gun to a location uphole of the previous stage; and perforating the current stage using the perforation gun.

The Abstract of the disclosure is solely for providing a way by which to determine quickly from a cursory reading the nature and gist of technical disclosure, and it represents solely one or more embodiments.

While various embodiments have been illustrated in detail, the disclosure is not limited to the embodiments shown. Modifications and adaptations of the above embodiments may occur to those skilled in the art. Such modifications and adaptations are in the spirit and scope of the disclosure.

What is claimed:

1. A method to perform wellbore completion operations, comprising:

perforating a production casing at a first location nearest a toe end of a wellbore to create a first stage of a plurality of spaced-apart clusters of perforations through said casing;

plugging said wellbore at a first plug location between a most uphole first and a second of said plurality of clusters of said first stage; and then perforating said casing at a second location uphole of said first stage to create a second stage of a plurality of spaced-apart clusters of perforations through said casing.

2. The method of claim 1 further comprising:

stimulating said formation at said second stage; whereby said first of said plurality of clusters of said first stage maintains fluid flow past each of said clusters of said second stage into said formation during said stimulating.

3. The method of claim 1 wherein:

said wellbore is a closed hole prior said perforating said first stage;

said perforating said first stage opens said wellbore to a formation; and said wellbore remains open after said plugging.

4. The method of claim 1 further comprising:

perforating said first stage using with a tubing-conveyed perforating gun.

5. The method of claim 1 further comprising:

providing a wireline bottom hole assembly having a settable plug and a perforating gun;

pumping said bottom hole assembly to said second location;

plugging said wellbore at said first plug location with settable plug by said bottom hole assembly; and perforating said second stage using said perforation gun.

6. The method of claim 5 wherein:

said settable plug includes a caged ball.

7. The method of claim 1 further comprising:

after said plugging said wellbore at said first plug location, pumping a tool into said wellbore.

8. The method of claim 1 further comprising:

plugging said wellbore between at least a most uphole first and a second of said plurality of clusters of said second stage; then perforating said casing at a third location uphole of said second stage to create a third stage of a plurality of spaced-apart clusters of perforations through said casing into a formation; and then stimulating said formation at said third stage, whereby said first of said plurality of clusters of said second stage maintains fluid flow past each of said clusters of said third stage into said formation during said stimulating of said third stage.

9. A method to perform wellbore completion operations, comprising:

running a first perforating gun to a first location nearest a toe end within a wellbore;

actuating said first perforating gun to create an initial stage of a plurality of spaced-apart clusters of perforations through a production casing thereby opening said wellbore to a formation;

running a bottom hole assembly carrying a second perforating gun and a deployable plug into said wellbore to a second location uphole of said initial stage;

deploying said plug to isolate said wellbore between a most uphole first and a second of said plurality of clusters of said initial stage; and actuating said second perforating to create a second stage of a plurality of spaced-apart clusters of perforations through said casing into said formation.

10. The method of claim 9 further comprising:

stimulating said formation at said second stage; whereby said first of said plurality of clusters of said initial stage maintains fluid flow past each of said clusters of said second stage into said formation during said stimulating.

11. The method of claim 9 wherein:

said wellbore is a closed hole prior said actuating said first perforating gun; and said wellbore remains open after said deploying said plug.

12. The method of claim 9 further comprising:

conveying said first perforating gun by coiled tubing.

13. The method of claim 9 further comprising:

running said bottom hole assembly by pumping said bottom hole assembly through said wellbore.

14. The method of claim 13 wherein:

said plug includes a caged ball.

15. The method of claim 9 further comprising:

after said deploying said plug, pumping a tool into said wellbore.

16. The method of claim 9 further comprising:

selectively actuating said second perforator while said second perforator is pulled uphole to create said second stage of a plurality of spaced-apart clusters of perforations through said casing into said formation.

17. A method to perform wellbore completion operations, comprising:

repetitively perforating and plugging a production casing in stages along a wellbore including, for each stage, perforating said casing along a current stage to create a plurality of spaced-apart clusters of openings through said casing, and plugging said wellbore between a most uphole first and a second of said plurality of clusters of a previously perforated stage.

18. The method of claim 17 further comprising:

stimulating a formation at said current stage; whereby said first of plurality of clusters of said previous stage maintains fluid flow past each of said clusters of said current stage into said formation during said stimulating.

19. The method of claim 18 further comprising:

providing a plug and a perforating gun;

pumping said plug and said perforating gun to a location uphole of said previous stage; and perforating said current stage using said perforation gun.

* * * * *